US011536098B2

(12) United States Patent
Deroubaix

(10) Patent No.: US 11,536,098 B2
(45) Date of Patent: Dec. 27, 2022

(54) LIFTING PLUG

(71) Applicant: VALLOUREC OIL AND GAS FRANCE, Aulnoye-Aymeries (FR)

(72) Inventor: Antoine Deroubaix, Boulogne-Billancourt (FR)

(73) Assignee: VALLOUREC OIL AND GAS FRANCE, Aulnoye-Aymeries (FR)

( * ) Notice: Subject to any disclaimer, the term of this patent is extended or adjusted under 35 U.S.C. 154(b) by 0 days.

(21) Appl. No.: 17/288,703

(22) PCT Filed: Oct. 28, 2019

(86) PCT No.: PCT/EP2019/079434

§ 371 (c)(1),
(2) Date: Apr. 26, 2021

(87) PCT Pub. No.: WO2020/089182

PCT Pub. Date: May 7, 2020

(65) Prior Publication Data

US 2021/0396082 A1 Dec. 23, 2021

(30) Foreign Application Priority Data

Oct. 30, 2018 (FR) ..... 1860053

(51) Int. Cl.
*E21B 19/06* (2006.01)
*E21B 17/042* (2006.01)

(52) U.S. Cl.
CPC ..... *E21B 19/06* (2013.01); *E21B 17/0426* (2013.01)

(58) Field of Classification Search
None
See application file for complete search history.

(56) References Cited

U.S. PATENT DOCUMENTS 2,624,609 A * 1/1953 Storm ..... E21B 19/00 294/86.4
2,624,610 A * 1/1953 Murphy ..... E21B 19/06 294/96

(Continued)

FOREIGN PATENT DOCUMENTS

WO WO 2011/090390 A1 7/2011

OTHER PUBLICATIONS

International Search Report dated Jan. 28, 2020 in PCT/EP2019/079434 filed on Oct. 28, 2019, 3 pages.

*Primary Examiner* — Kipp C Wallace
(74) *Attorney, Agent, or Firm* — Oblon, McClelland, Maier & Neustadt, L.L.P.

(57) ABSTRACT

A lifting plug is for lifting a tubular column in a gas and/or oil well. The lifting plug is a one-piece component capable of being manipulated by a jaw of an oil platform elevator. The plug includes a body to be screwed onto the tubular column. The body includes two outer flanges: an upper flange and an intermediate flange. The flanges are such that the jaw of the elevator can be arranged between these two flanges. The upper flange forms a bearing shoulder for the jaw to bear on and the intermediate flange includes a bore for manipulating the plug allowing the insertion through the body of a pin emerging at two different points of the intermediate collar. The plug can be rotated by the pin while remaining engaged in the jaw.

9 Claims, 2 Drawing Sheets

(56) References Cited

U.S. PATENT DOCUMENTS

| | | | | |
|---|---|---|---|---|
| 3,888,318 | A * | 6/1975 | Brown | E21B 19/10 173/149 |
| 4,395,061 | A * | 7/1983 | Helzer | E21B 49/08 285/98 |
| 4,479,537 | A | 10/1984 | Reed | |
| 5,050,673 | A | 9/1991 | Baldridge | |
| 2013/0255956 | A1 | 10/2013 | Gilmore et al. | |
| 2014/0262335 | A1* | 9/2014 | Bull | E21B 19/02 166/379 |
| 2017/0088401 | A1* | 3/2017 | Clements | B66C 1/62 |

* cited by examiner

LIFTING PLUG

BACKGROUND

The present invention relates to a lifting plug intended to be engaged with an oil platform elevator to facilitate the handling and assembly of tubular elements together so as to form a tubular column for drilling and/or pumping a hydrocarbon well. The elevator is one of the essential pieces of equipment of an oil platform, particularly described in the standards API 8B and 8C.

The term tubular element intended for drilling and/or operating hydrocarbon wells denotes any element of substantially tubular shape capable of being assembled with another element of substantially tubular shape, particularly by screwing, with a view to forming a pipe string intended either to drill a hydrocarbon well, or to form a submarine riser for the maintenance or operating of such wells, or to case the well, or a production column (also known as tubing) involved in operating the well. The lifting plug according to the invention can also be used for lowering heavy loads into a well.

During the assembly of a pipe string, it is necessary to add the tubular elements gradually above the well. Therefore, there are pre-assembled tubes forming the start of the pipe string which are retained in the well such that the final tube added emerges from the well. And in the vicinity of the well, there is a stock of tubular elements which will be added to the pipe string to form the tubular column. The aim of the present invention is that of facilitating the addition of the additional tubular elements to the pipe string.

BRIEF SUMMARY

In particular, the invention relates to a lifting plug operated by an elevator on a hydrocarbon well drilling and/or production platform. In practice to form the tubular column, the lifting plug is mounted on an tubular element from a stock of tubes positioned horizontally. The tubes are assembled 3 by 3 to form sections of three tubes, which are then stored vertically. The lifting plug makes it possible to facilitate the handling of individual tubes to form the sections of three tubes. For the movement of the tubular elements, the lifting plug is gripped in a jaw of an elevator, and this elevator then moves the assembly formed by the lifting plug attached to the tubular element. The elevator makes it possible to transport this new tubular element, just like a section of three tubes, above a pipe string already in the well. The new tubular element is screwed by means of a screwing table to the pipe string. After this screwing, the elevator enables the lowering of the entire pipe string into the well, such that the pipe string is lowered to the platform, to make it possible to detach the lifting plug.

When using the lifting plug, the latter must withstand tensile loads equivalent to the weight of a tube, a section of three tubes, and also to the weight of an entire pipe string.

To each tubular element corresponds a specific lifting collar. Indeed, to be capable of being mounted on a tubular element, the lifting plug must have a complementary thread in respect of that of this tubular element. In fact, the larger the diameter of the tubular elements to be assembled, the larger the diameter of the lifting plug per se. Furthermore, as this lifting plug must be engaged in the jaw of an elevator and withstand the tensile or compression forces at the jaw, and also tensile forces associated with the weight of the tubular element to be moved, this lifting plug is preferably made of steel and has mechanical properties enabling the required use. The lifting plug is for example made of low-alloy steel according to the European standard EN10027.

Compliance with operator safety standards on an oil platform requires that the loads to be handled by operators do not exceed a certain weight. However, the weight of the lifting plugs for some sizes exceeds the required limits. It is then necessary to equip the platform with tools specifically intended for aiding the handling of the lifting plug, or more simply reuse the elevator available on the platform. However, when the operator wishes to use the elevator, the lifting plugs according to the prior art require a high number of handlings of the elevator jaw relative to the lifting plug.

For example, at the end of screwing a new tubular element on a pipe string, the jaw must release the lifting plug to enable the detachment thereof from the tubular element. When the lifting plug is detached from the tubular element, it is necessary to use other handling equipment, such as a pallet truck, to move it again. Transported to a new tubular element, the lifting plug is screwed thereon, and only then the elevator jaw will be positioned around the lifting plug.

While this method complies with oil platform safety standards, it is time-consuming and costly in labour time to observe, and in number of handling operations. As each handling operation involves a risk, the occurrence of incidents becomes statistically greater. There is therefore a need to reduce the handling time, and in particular reduce the number of handling operations. There is also a need to reduce the time and costs for assembling the pipe strings.

The invention proposes a solution for the problem posed by proposing a lifting plug which can be mounted and dismounted from the tubular elements to be moved while remaining engaged in the elevator jaw. To this end, the invention relates to a lifting plug for lifting a tubular column in a gas and/or oil production well, the lifting plug including a body and a thread at an axial end of this body to cooperate by screwing with a threaded portion of a tubular element of the tubular column, the body including a cylindrical surface capable of being disposed in a jaw of an oil platform elevator, the body including two outer flanges, an upper flange and an intermediate flange, such that the cylindrical surface of the body is disposed between the two outer flanges, the upper flange forming a shoulder against which the elevator jaw can bear, characterised in that the intermediate flange includes a bore for handling the plug allowing the insertion through the body of a rod emerging at two different points of the intermediate flange.

Advantageously, the handling bore can include a first orifice opening radially outwards relative to a longitudinal axis of the body. Preferably, the handling bore can include a second orifice opening radially outwards relative to a longitudinal axis of the body, this second orifice being diametrically opposite the first orifice.

In particular, the upper flange can be disposed at a second end of the plug body, opposite an end of this body adjacent to the thread, relative to a longitudinal axis of the body.

More specifically, the intermediate flange can be disposed between the cylindrical surface and the thread.

Preferably, the outer diameter of the cylindrical surface can be equal to the outer diameter of the tubular element whereon the lifting plug is screwed, particularly equal to the nominal outer diameter of this tubular element. The nominal outer diameter is considered according to the uses, at a distance from the threaded ends of this tubular element, referred to as "nominal pipe body outer diameter".

Advantageously, the body can be hollow and open via the two longitudinal ends thereof. This arrangement lightens the handling weight of the lifting plug and facilitates the circulation of drilling mud where applicable.

To limit the number of handling operations of an elevator jaw around the lifting plug, a distance between a shoulder of the upper flange and an annular surface of the intermediate flange facing this shoulder can be greater than an axial length of the thread, in particular at least 1.5 times greater than this axial length of the thread.

Preferably, the lifting plug can be made of one piece, particularly obtained by machining a billet.

According to a preferred embodiment, the thread can be formed on the outer perimeter of an external surface of the body.

BRIEF DESCRIPTION OF THE DRAWINGS

The present invention will be understood more clearly on reading the detailed description of some embodiments taken as non-restrictive examples and illustrated by the appended drawings, wherein.

DETAILED DESCRIPTION

Figure 1:
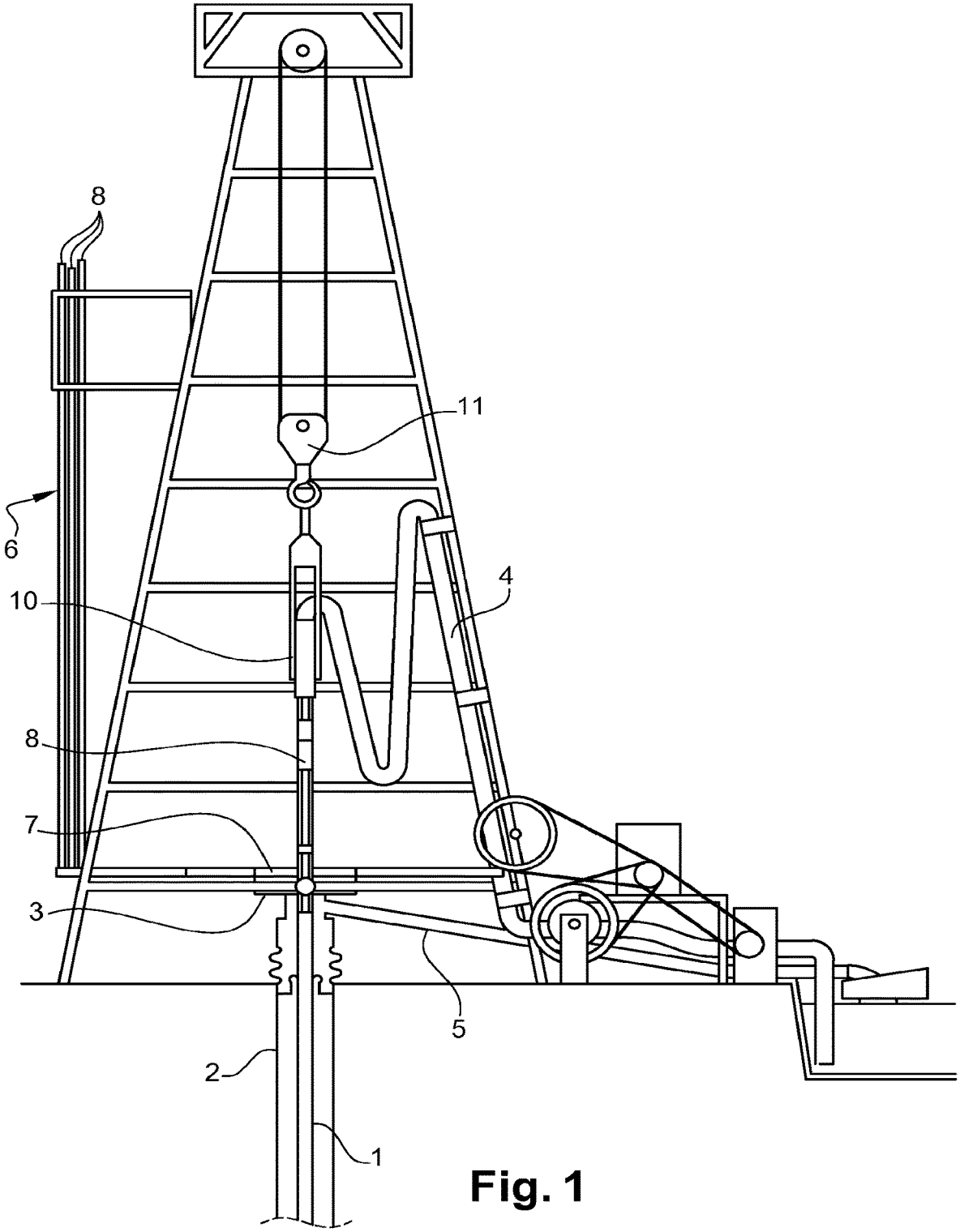
FIG. 1 schematically illustrates the equipment of an oil platform, particularly when assembling tubular elements on a tubular column fitted on an exploratory or producing well.

FIG. 1 schematically represents an oil platform when installing a column 1, also referred to as pipe string 1, in a well 2. A start of the pipe string is retained in the well 2 by retention means, such as a locking table 3. The well 2, including during the in-depth insertion of the pipe string, is supplied by a stream of drilling mud moving downwards 4 inside the pipe string and upwards 5 between the pipe string and the walls of the well.

In the vicinity of the well, there is a stock 6 of tubular elements 8 which it will be necessary to successively add to the pipe string 1 to form the column usable for drilling and/or operating the well 2. The oil platform is equipped with means enabling the progressive addition of the tubular elements from the stock 6 to the column 1. The platform particularly includes a screwing key 7 for rotating a tubular element so as to obtain the screwing thereof on the pipe string 1 retained by the locking table 3.

In particular, the invention relates to a lifting plug 10 operated by an elevator 11 of the platform. In practice to form the tubular column 1, the lifting plug is mounted on a tubular element 8 from the stock 6, and once it is engaged on this tubular element 8, the elevator 11 cooperates with this lifting plug 10 for the movement of the tubular element next to the column 1 under formation. The tubular element 8 can also be referred to as a pipe 8, or tube 8.

According to an embodiment of the invention, the lifting plug 10 includes a hollow tubular body 12 of longitudinal axis X. The body 12 is preferably made of steel.

Figure 2:
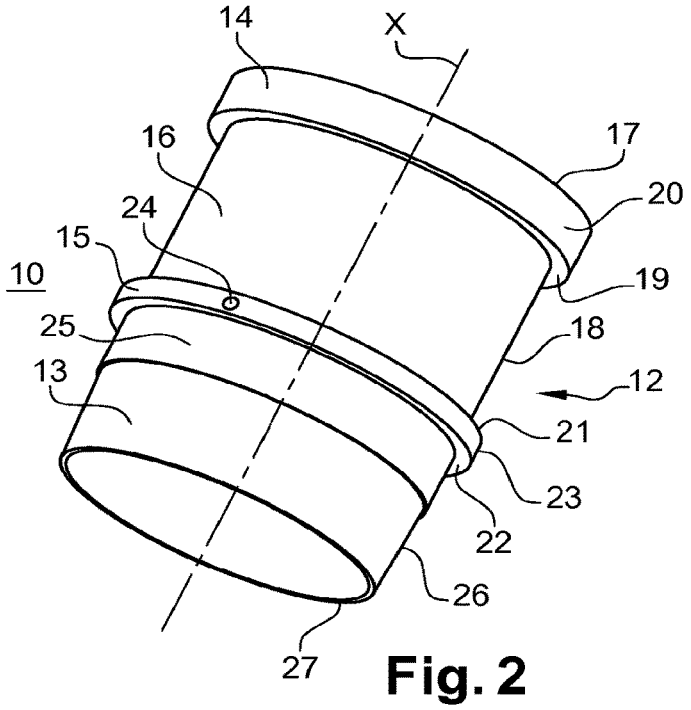
FIG. 2 illustrates a perspective view of an embodiment of a lifting plug according to the invention.
Figure 3:
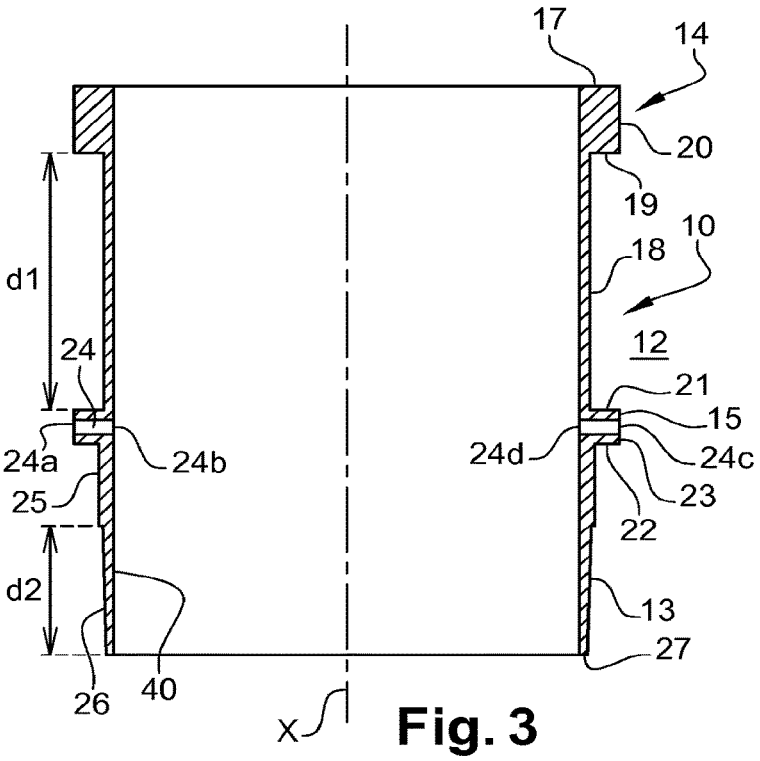
FIG. 3 is a longitudinal sectional view of the lifting plug according to FIG. 2.

In the example represented in FIGS. 2 and 3, the tubular body 12 is provided on a part of the outer perimeter thereof with a thread 13. In this case, the lifting plug is intended to cooperate by screwing with a tubular element 8 which would be provided with a threaded end on the inner perimeter thereof. The tubular element 8 is for example a pipe having a male thread oriented towards the ground at one end, and provided at the other end thereof with a female thread. This is referred to as an integral-joint column. Alternatively, the tubular element can be an assembly composed of a pipe having a male thread oriented towards the ground, and provided at the other end thereof with another male thread, itself already screwed into a sleeve provided respectively with female threads at both ends of the inner perimeter thereof. This is referred to as a T&C type joint column formed from the association of a pipe and a sleeve.

In an example not shown, the body 12 can alternatively be provided with a thread on the inner perimeter thereof, to cooperate with a male threaded end of a tubular element.

The body 12 has an axis of revolution X. In the example represented, where the tubular body 12 has an outer thread 13, the body 12 includes a tapered portion 26 from which the thread 13 protrudes. In an alternative embodiment not shown, the surface 26 is not tapered but cylindrical, the thread 13 then emerging from this cylindrical surface. The surface 26 is defined by an enclosure surface passing via the roots of the thread 13. The thread 13 is machined. The body 12 includes next to the thread 13 a cylindrical internal surface 40 of constant inner diameter along the axis X, in order to ensure the critical sections of the connection formed between the plug and a pipe to which it is screwed. Indeed, the lifting plug can be useful for lifting a column 1 formed of several tens, or even hundreds, of pipes, the connection thus formed between the lifting plug and the tube 8 must make it possible to hold these loads.

The inner diameter of the internal surface 40 is equal to the inner diameter observed next to the threaded portion of the tube 8. In practice if the tube 8 has an inner connection diameter Y, with manufacturing tolerances of plus $\alpha 1$ and/or minus $\beta 1$, then the inner diameter of the cylindrical surface 40 will be machined according to the same tolerances as those of the tube, namely with an inner diameter between $Y-\beta 1$ and $Y+\alpha 1$. Preferably, the inner diameter of the cylindrical surface 40 will be less than or equal to Y, such that the inner diameter of the cylindrical surface 40 will be for example between $Y-\beta 1$ and Y.

The body 12 includes an upper flange 14 and an intermediate flange 15 extending respectively radially outwards on either side of a tubular portion 16. The upper flange 14 defines an edge 17 orthogonal to the axis X defining a first axial end of the body 12. According to the embodiment represented, the edge 17 defines an axial end of the body 12. The thread 13 is machined up to a second axial end 27, opposite relative to the axis X, the edge 17. The body 12 has an axial length between the two axial ends 17 and 27 thereof of the other of 800 mm, for example between 500 and 1200 mm.

The upper flange 14 and the intermediate flange 15 are outer flanges. The tubular portion 16 has an inner diameter, along the axis X, from the upper flange 14 to the intermediate flange 15. The outer diameter of the tubular portion 16 is dependent on the nominal outer diameter of the tube 8. In practice if the tube has a nominal outer diameter X, with manufacturing tolerances of plus $\alpha 2$ or minus $\beta 2$, then the outer diameter of the tubular portion 16 will have the same manufacturing tolerances as that of the tube 8, namely with an outer diameter between $X-\beta 2$ and $X+\alpha 2$. Preferably, the outer diameter of the tubular portion 16 may be greater than or equal to X, in particular between X and $X+\alpha 2$.

The tubular portion 16 defines a cylindrical external surface 18, such that the wall thickness of this tubular portion 16 is constant between the two flanges 14 and 15.

The inner diameter of the tubular portion is for example constant and equal to the inner diameter observed next to the flanges 14 and 15.

The upper flange 14 has for example an outer diameter representing at least 105% of the outer diameter of the tubular portion 16. The upper flange 14 has a length along the axis X of the order of 80 mm to 120 mm.

The upper flange 14 includes a surface perpendicular to the axis X, formed by the edge 17, and a shoulder 19 between a cylindrical perimeter 20 of the upper flange 14 and the external cylindrical surface 18 of the tubular portion 16. The cylindrical perimeter 20 extends between the edge 17 and the shoulder 19.

Figure 4:
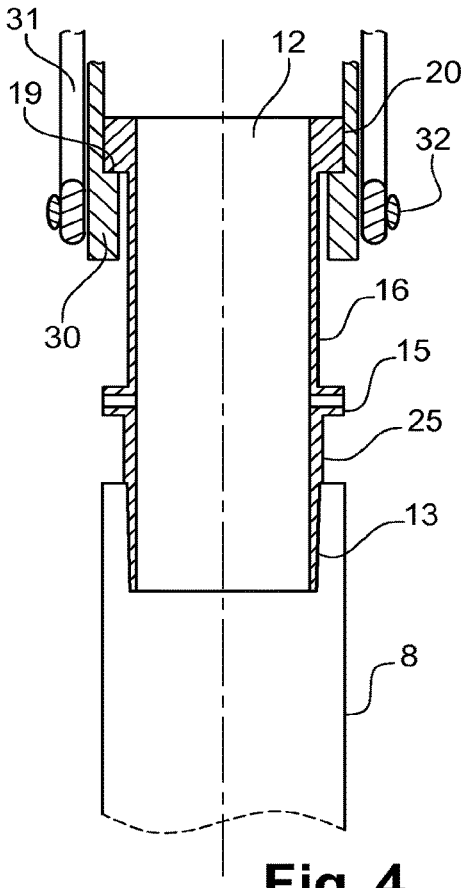
FIG. 4 is a longitudinal sectional view of the lifting plug according to FIG. 2 retained on a tubular element and engaged in an elevator.

A jaw 30 is retained by a pivot 32 in slings 31, together they form a part of the elevator 11. This jaw 30 is intended to engage around the tubular portion 16. Alternatively, and as represented in FIG. 4, this jaw 30 does not come into contact with the external cylindrical surface 18, but in contact with the shoulder 19. The body 12 is then handled by the elevator, suspended by bearing on the jaw 30. The upper flange 14 is then configured to withstand the tensile weight of a tubular element to which it would be attached to ensure the movement thereof.

The intermediate flange 15 has for example an outer diameter representing at least 105% of the outer diameter of the tubular portion 16. The intermediate flange 15 has a length along the axis X of the order of 50.8 mm to 76.2 mm.

The intermediate flange 15 has an outer diameter equivalent to that of the upper flange 14. The intermediate flange 15 has an axial length along the axis X less than that of the upper flange 14.

The intermediate flange 15 includes two annular surfaces respectively 21 and 22 perpendicular to the axis X connected by an intermediate cylindrical perimeter 23 of the intermediate flange 15. The annular surface 21 is facing the shoulder 19. The intermediate cylindrical perimeter 23 defines the length of the intermediate flange 15 along the axis X.

The intermediate flange 15 includes a handling bore 24 having a first orifice 24*a* opening radially outward at the intermediate cylindrical perimeter 23. The handling bore 24 is through and also opens radially inwards via another other orifice 24*b* at the internal cylindrical perimeter 40.

This handling bore is intended to receive a handling rod. According to the cross-section of the rod, the cross-section of the bore is adapted. In practice, in the example shown, the cross-section of the bore 24, and therefore of the through orifices 24*a* and 24*b* are circular. In particular, the diameter of the orifices 24*a* and 24*b* is between 20 and 30 mm.

As represented in FIG. 3, the handling bore 24 includes a second orifice 24*c* opening radially outwards relative to a longitudinal axis of the body, this second orifice 24*c* being diametrically opposite the first orifice 24*a*.

Preferably, the handling rod is intended to traverse the body 12 via the two diametrically opposite orifices 24*a* and 24*c*, the bore 24 therefore opens via a fourth orifice 24*d* located facing the orifice 24*b*. This arrangement of the orifices 24*a*, 24*b*, 24*c* and 24*d* allows a better distribution of the pressure contact points between the handling rod and the body 12. The cross-sections of the orifices 24*a*, 24*b*, 24*d* and 24*c* are for example identical.

The annular surface 21 of the intermediate flange 15 is located at a distance d1 from the shoulder 19, this distance d1 representing between 100 and 1000% of an axial length d2 of the thread 13, preferably at least 150% of the length d2. For example, this distance d1 is between 300 and 400 mm. This arrangement makes it possible to leave the jaw 30 around the portion 16, particularly during the unscrewing operations of the lifting plug 10 relative to the tube 8 newly added to the pipe string 1. The height d1 is in particular greater than or equal to the sum of the heights of an elevator jaw and the axial length d2 of the thread 13.

To allow the unscrewing of the lifting plug, the pipe string is lowered, and the locking table 3 is clamped around the new tube 8 added. The lifting plug is then at a level with this locking table, at eye level to allow the handling thereof via a handling rod. During the manual unscrewing, via the handling rod, the lifting plug rises axially relative to the tube 8 and to the locking table 3. The jaw 30 remaining suspended from the slings 31, the jaw 30 remains at a constant altitude relative to the locking table 4. During the unscrewing thereof, the lifting plug 10 is raised relative to the jaw. The intermediate flange makes it possible to limit the axial position of the jaw 30, and thus avoid the jaw 30 left engaged around the lifting plug 10 damaging the thread 13.

The body 12 includes a non-threaded annular portion 25 between the thread 13 and the intermediate flange 15. In this case, this non-threaded annular portion 25 is located between the thread 13 and the annular surface 22 of the intermediate flange 15. This non-threaded annular portion 25 makes it possible to give the option of increasing the service life of the lifting plug, by providing a material zone for machining a new thread 13 once again. This newly machined thread 13 is then closer to the intermediate flange 15.

Thanks to the lifting plug according to the invention, it is possible to engage the thread 13 in a complementary thread while the plug is retained in the jaw 30 of an elevator. Indeed, the plug bearing on the jaw, this bearing tolerates a rotation of the lifting plug relative to the jaw. The rotation of the lifting plug is carried out manually using a handling rod inserted into the bore 24, this rotation allowing a screwing of the thread 13 in a complementary threaded portion of a tube to be handled or to be added to a tubular column.

In practice, the thread 13 is compatible with the threaded portion of the tube to be handled, but the thread profile is designed in counter-relief with that of the threaded portion so as to avoid any risks of seizing during the screwing of the plug on the tube. In particular, the sides, the tops and roots of the thread 13 are sized so as not to create interference with the threaded portion of the tube to be handled. On the other hand, the pitch of the thread 13 corresponds to that of the threaded portion of the tube to be handled.

Indeed, the lifting plug must not damage the surfaces of the threaded portion which have been designed to be brought into interference with a complementary threaded portion of a tube with a view to the formation of a pipe string. In the case where the threaded portion provided on the tube to be handled provides surfaces intended to form a seal, particularly metal-metal type seals, the lifting plug is designed such that it has no surface in contact with such sealing surfaces. For example, the lifting plug can be designed so as not to have any surface radially facing such sealing surfaces.

Throughout the description, the expression "including a" should be considered to be synonymous with "including at least one", unless specified otherwise.

The invention claimed is:

1. A lifting plug for lifting a tubular column in a gas and/or oil production well, the plug comprising:

a body and a thread at an axial end of the body to cooperate by screwing with a threaded portion of a tubular element of the tubular column, the body including a cylindrical surface configured to be disposed in a jaw of an oil platform elevator, the body including two outer flanges, including an upper flange and an intermediate flange, such that the cylindrical surface of the body is disposed between the two outer flanges, the upper flange forming a shoulder against which the elevator jaw is configured to bear, wherein the intermediate flange includes a bore configured to handle the plug allowing the insertion through the body of a rod emerging at two different points of the intermediate flange, wherein the handling bore includes a first orifice opening radially outwards relative to a longitudinal axis of the body and a second orifice opening radially outwards relative to a longitudinal axis of the body, the second orifice being diametrically opposite the first orifice, wherein the lifting plug is made of one piece, wherein an inner diameter of the lifting plug is constant over an entirety of the lifting plug, wherein a length of the upper flange in a longitudinal direction of the lifting plug is greater than a length of the intermediate flange in the longitudinal direction, wherein an outer diameter of the upper flange is equal to an outer diameter of the intermediate flange.

2. The lifting plug according to claim 1, wherein the upper flange is disposed at a second end of the plug body, opposite the axial end adjacent to the thread, relative to a longitudinal axis of the body.

3. The lifting plug according to claim 1, wherein the intermediate flange is disposed between the cylindrical surface and the thread.

4. The lifting plug according to claim 1, wherein the outer diameter of the cylindrical surface is equal to the outer diameter of the tubular element whereon the lifting plug is screwed at a distance from the threaded ends of the tubular element.

5. The lifting plug according to claim 1, wherein the outer diameter of the cylindrical surface is equal to the nominal outer diameter of the tubular element whereon the lifting plug is screwed at a distance from the threaded ends of the tubular element.

6. The lifting plug according to claim 1, wherein the body is hollow and open via the two longitudinal ends thereof.

7. The lifting plug according to claim 6, wherein a distance between a shoulder of the upper flange and an annular surface of the intermediate flange facing the shoulder is greater than an axial length of the thread.

8. The lifting plug according to claim 6, wherein a distance between a shoulder of the upper flange and an annular surface of the intermediate flange facing the shoulder is at least 1.5 times greater than an axial length of the thread.

9. The lifting plug according to claim 1, wherein the thread is formed on an outer perimeter of an external surface of the body.

* * * * *